US005384561A

United States Patent [19]

Smith

[11] Patent Number: 5,384,561

[45] Date of Patent: Jan. 24, 1995

[54] BRISTLE DART ELECTRONIC SCOREBOARD

[76] Inventor: Robert J. Smith, 1225 Cheltenham, 1A, Glen Elyn, Ill. 60137

[21] Appl. No.: 8,498

[22] Filed: Jan. 25, 1993

[51] Int. Cl.[6] ..... G08B 23/00

[52] U.S. Cl. ..... 340/323 R; 273/DIG. 26; 364/411; 377/5

[58] Field of Search ..... 340/323 R; 377/5; 273/DIG. 26; 364/410, 411

[56] References Cited

U.S. PATENT DOCUMENTS

| | | | |
|---|---|---|---|
| 4,266,214 | 5/1981 | Peters, Jr. | 340/323 R |
| 4,286,323 | 8/1981 | Meday | 340/323 R |
| 4,567,461 | 1/1986 | Honekman et al. | 340/323 R |

*Primary Examiner*—Brent Swarthout

[57] ABSTRACT

A portable electronic scoreboard for use with a game of darts is designed to be used with a real dart board without the need of connecting electronics. The scoreboard is totally self contained and provides the appeal of a high tech electronic scoreboard without the accompanying expense and complexity. The scoreboard can also be utilized to play the game of cricket.

1 Claim, 4 Drawing Sheets

BRISTLE DART ELECTRONIC SCOREBOARD

BACKGROUND OF THE INVENTION

1. Field of the Invention

Thep present invention relates to amusement equipment and more particularly pertains to an improved electronic scoreboard for a dart game.

2. Description of the Prior Art

The use of portable electronic scoreboards is known in the prior art. However, none of the electronic scoreboards are particularly designed for use with the game of darts, as well as the game of cricket and accordingly there appears to be a need for such scoreboards whereby the electronic scoring of a game could be achieved without the necessity of a complex electronic circuit. In this respect, the present invention substantially fulfills this need.

SUMMARY OF THE INVENTION

In view of the foregoing disadvantages inherent in the known types of electronic scoreboards now present in prior art, the present invention provides an improved electronic scoreboard construction wherein the same can be utilized to keep scores associated with conventional dart games as well as the game of cricket. As such, the general purpose of the present invention, which will be described subsequently in greater detail, is to provide a new and improved electronic scoreboard which has all advantages of the prior electronic scoreboards and none of the disadvantages.

To attain this, the present invention essentially comprises an electronic scoreboard which is designed to augment a players awareness of his/her present score. The electronic scoreboard incorporates an electronic display system with "instant update" to keep scores current as each player retrieves his/her darts. Electronics are configured to indicate the present dart game being played, the last player who played, and all current scores. The scoreboard is also portable (battery operated) and is designed to hang on a wall during use. An instruction card holder is provided for those who are not completely familiar with the game or for those who need refreshing on the scoring principles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electronic scoreboard which has all the advantages of the prior art electronic scoreboards and none of the disadvantages.

It is another object of the present invention to provide a new and improved electronic scoreboard which may be easily and efficiently manufactured and marketed.

It is a further object of the present invention to provide a new and improved electronic scoreboard which is of a durable and reliable construction.

An even further object of the present invention is to provide a new and improved electronic scoreboard which is susceptible of a low cost of manufacture with regard to both materials and labor, and which accordingly is then susceptible of low prices of sale to the consuming public, thereby making such electronic scoreboards economically available to the buying public.

Still yet another object of the present invention is to provide a new and improved electronic scoreboard which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
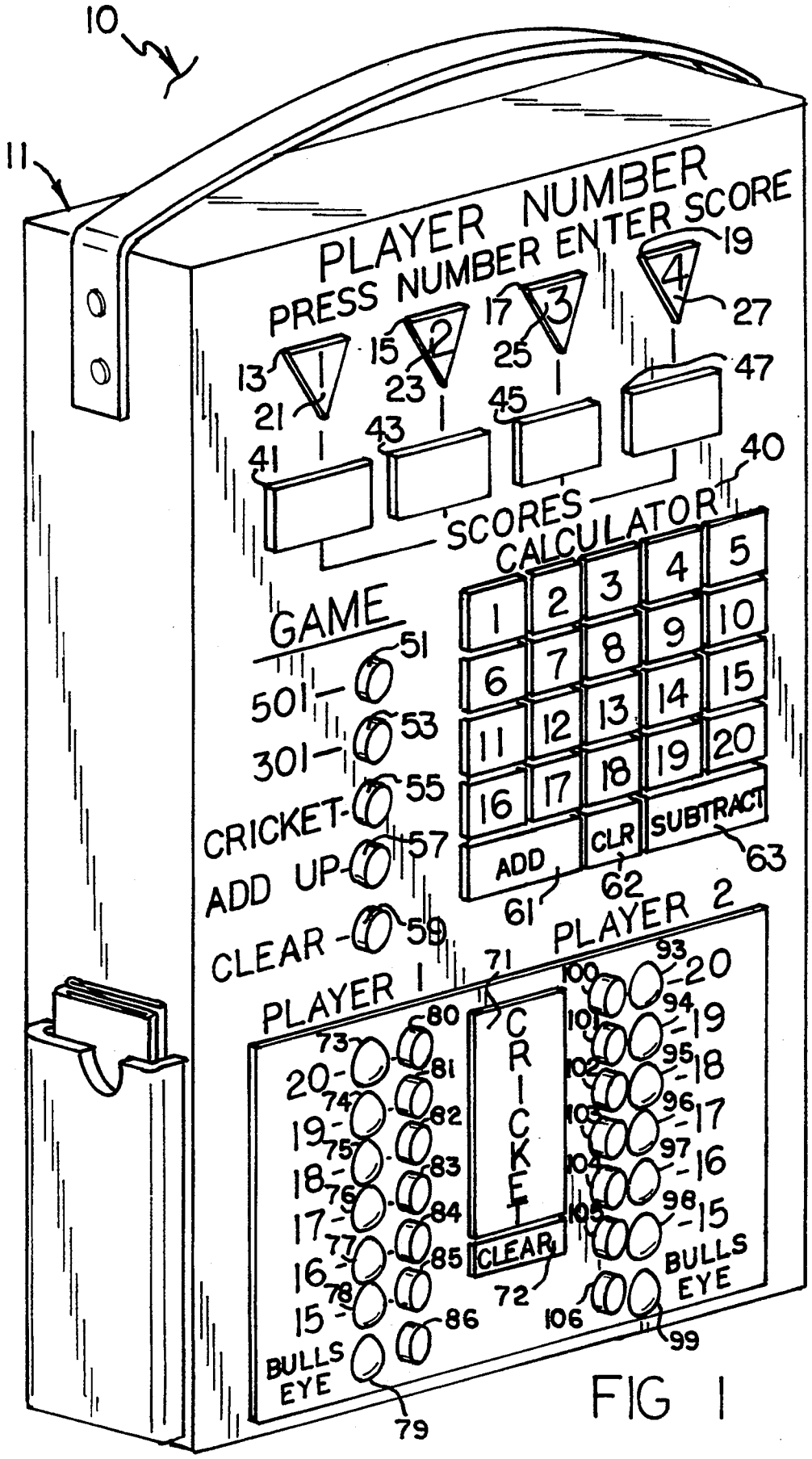
FIG. 1 is a perspective view of the electronic scoreboard comprising the present invention.
Figure 2:
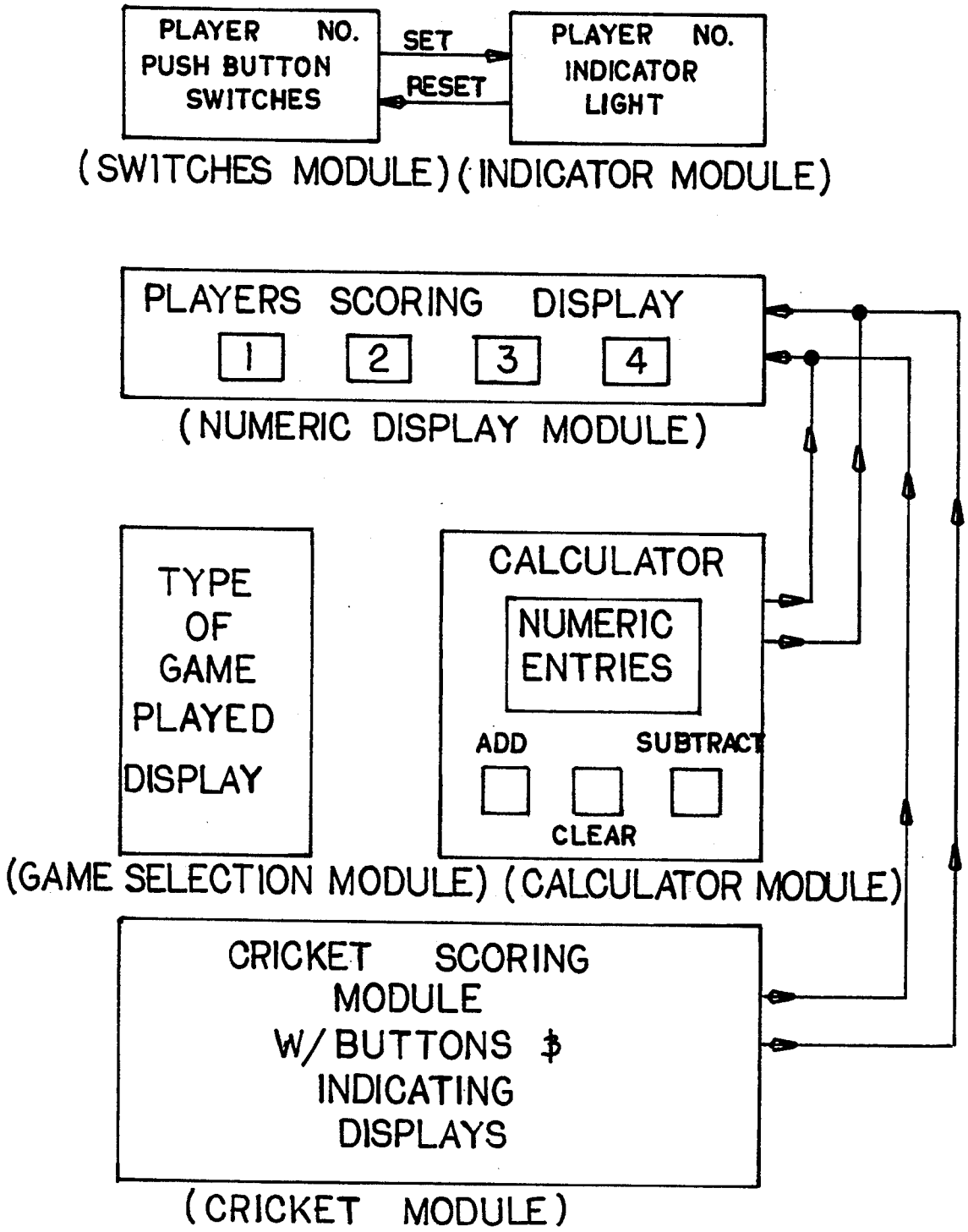
FIG. 2 is a block diagram illustrating the manner of operation of the present invention.
Figure 3:
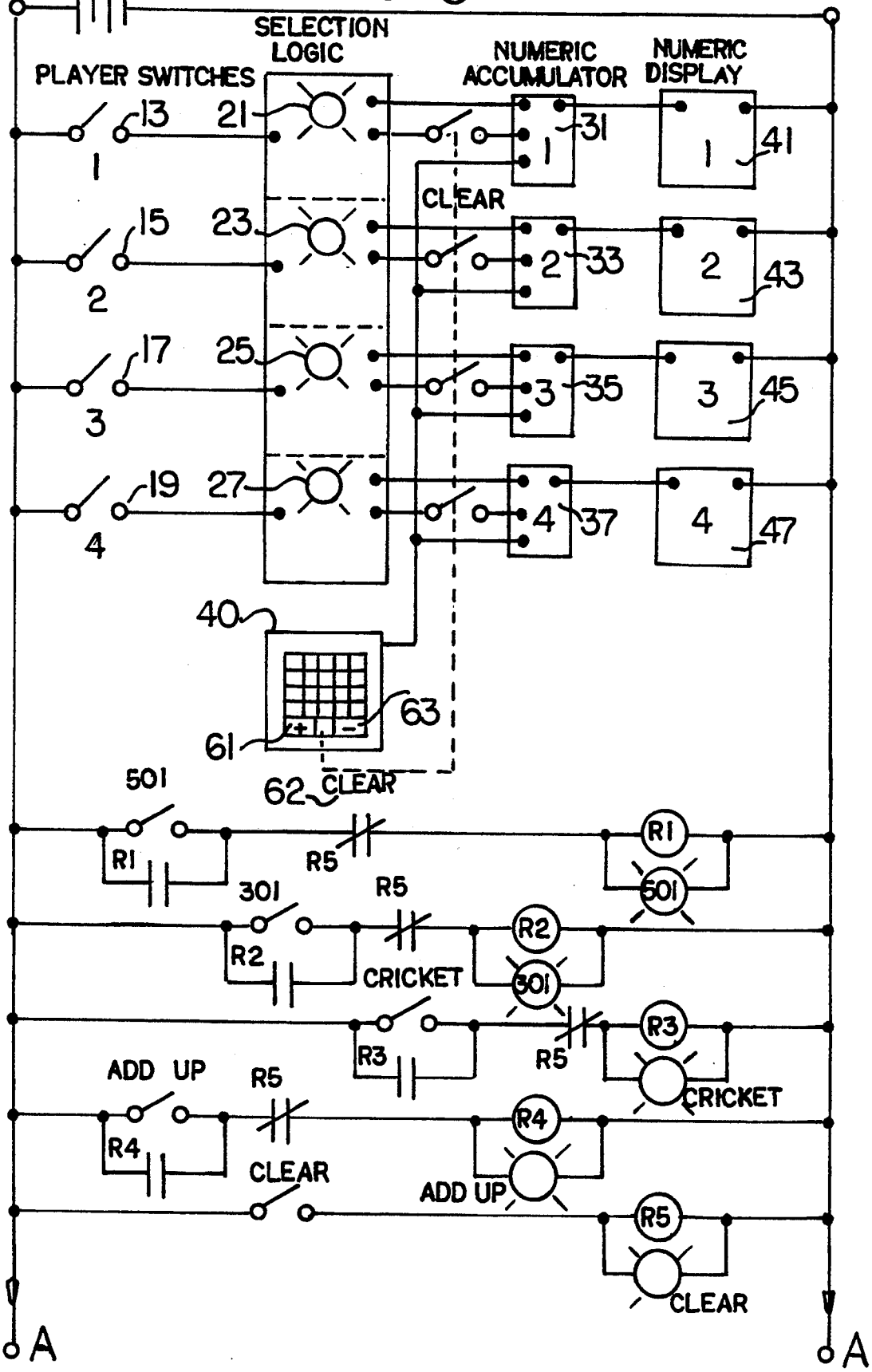
FIG. 3 is a partial control logic schematic illustrating the electronic components utilizable in a preferred embodiment of the invention.

With reference now to the drawings, and in particular to FIG. 1 thereof, a new and improved electronic scoreboard embodying the principles and concepts of the present invention and generally designated by the reference numeral 10 will be described.

More specifically, it will be noted that the display unit 10 includes four player selection switches 13, 15, 17, 19 having respective player indicators 21, 23, 25, 27 illustrated thereon. The entire scoreboard 10 is retained within a carrying case 11. Battery supplied power is normally turned off by an electronic power on/off module every 30 minutes when player selection buttons 13, 15, 17, 19 have not been activated. If any player selection button 13, 15, 17, 19 is pressed when the power is off, the system will send a clear signal from the calculator 40 to the respective player's number accumulator 31, 33, 35, 37 and the associated player numeric display 41, 43, 45, 47 which will clearly indicate zeros to start a new game.

Figure 4:
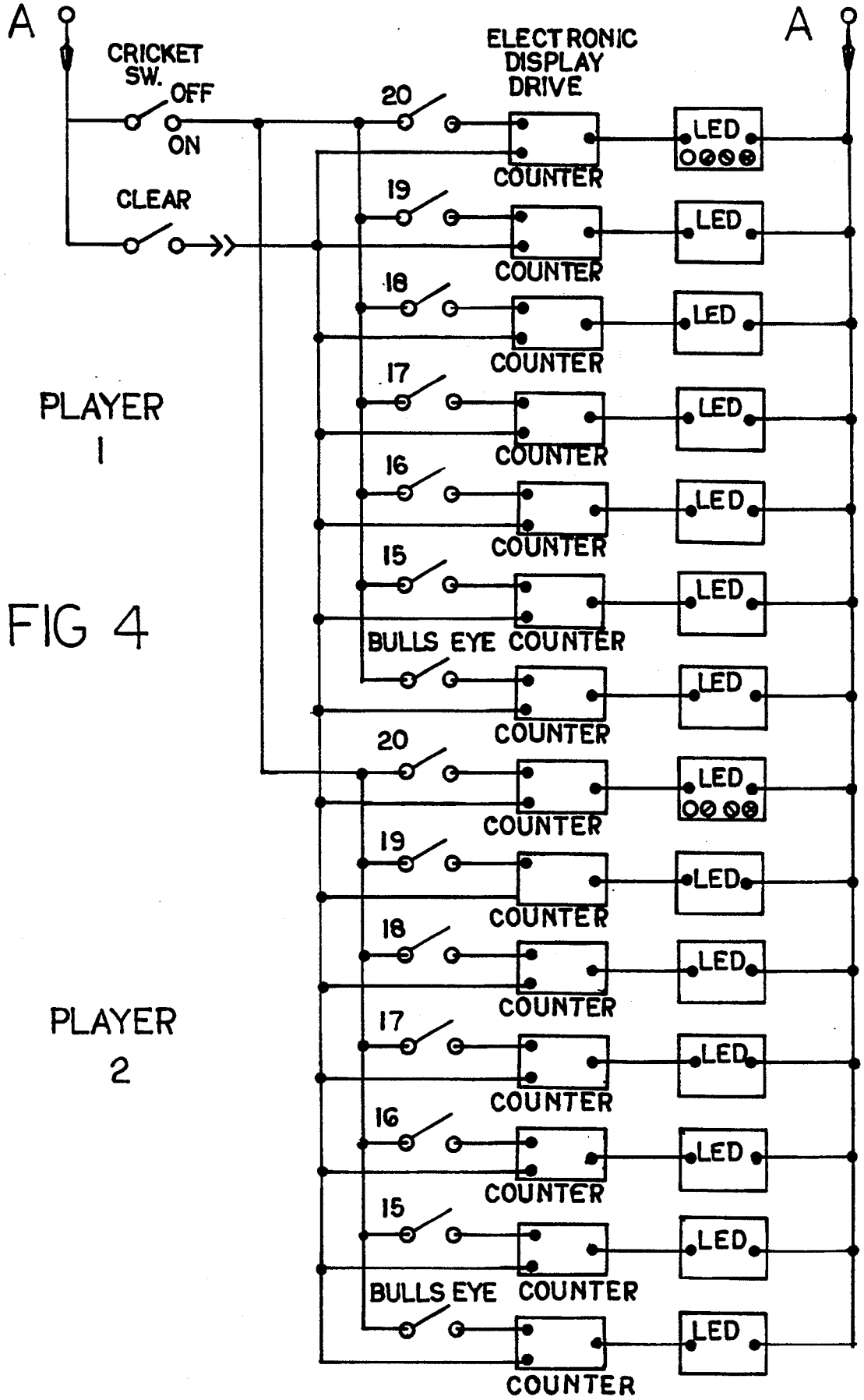
FIG. 4 is the remaining portion of the control logic schematic shown in FIG. 3.

Switches 13, 15, 17, 19 forming the switch module are actuated by a player to illuminate respective lamps 21, 23, 25, 27 comprising the lamp module, thereby to set up his particular scoring display path (numeric module) from the calculator module. As player one strikes button/switch 13, the circuitry path is energized so that the lamp 21 is illuminated, the numeric accumulators are zeroed, and a numeric display indicates zeros. The above process is identical in operation for all other players (two, three, four) and this represents the initiation of a game. Game selection switches 51, 53, 55, 57, 59 can be used to preset the calculator 40 to a preset number arranged by the logic module shown in FIG. 4, thereby to pre-initialize the display to the specific number (501, 301 or all zeros). The game clear button 59 (game reset) when pressed will send a signal to the calculator 40 which will in turn send zeros to the accumulators, thereby to have further zeros sent to the players' numeric display.

With respect to the playing of the game cricket with the present invention, the game button 55 must be pressed or the cricket button 70 may alternatively be pressed to send power to the cricket game lamp 55 and the cricket players' panel lamp 71. With either of these buttons pressed, the circuitry for the cricket game is energized. As the players throw their darts, the players' scores are entered on the cricket game players scoring section as follows:

Player (1) has darts in, for example, 16, 18, 20 and he then presses button 84 to record the score of 16, button 82 to record the score 18, and button 80 to record the score 20. The circuitry for these LED's will present a [/] on the LED face for LED 77 (16), LED 75 (18), and LED 73 (20) respectively. It should be noted that an LED displaying a [/] will indicate the first occurrence of that number being hit, a [ ] will indicate the second occurrence of that number being hit, and a [X] will indicate the third occurrence (winner) of that number being hit.

At this point, player (2) will press the corresponding buttons for his numbers for that session, and player (1) again throws his darts in 15, 18, 19. He then presses button 85 (15), button 82 (18), button 81 (19), and the corresponding LED's will function as follows:

LED 78 ( 15 ) will display [/], LED 75 ( 18 ) will display [ ], and LED 74 (19) will display [/]. The bullseye button, either 86 or 106, will cause LED 79 or LED 99 to indicate [X] on a single press. The clear button 72 will cause all LEDs to indicate neutral ( blank ) on the face.

With respect to playing darts and when all players are ready to play, player (1) throws his darts for the game and prepares to enter his score on the scoreboard. He enters the score by pressing one button on the calculator 40. Pressing the ADD button on the calculator will send this numeric value to the accumulator 31, and this in turn is summed and then displayed on the player (1) numeric display 41. As player (2) throws his darts for the game, he will enter the score on calculator 40 in the same manner as player (1), with players (3) and (4) following in sequential order. As player (1) again plays his turn, the score is entered into the calculator 40 and again the ADD button 61 is pressed so that the accumulator 31 sums the score and sends its value to the numeric display 41. All other players (2)–(4) will again sequentially proceed in the same manner. Upon completion of the game, the CLEAR button 62 on the calculator 40 is pressed and the system functions are used to clear the accumulators 31, 33, 35, 37 so that the numeric displays 41, 43, 45, 47 will show zeros on their associated displays.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A electronic scoreboard for the game of darts and cricket, said scoreboard comprising:

a power supply having means for shutting off said power supply after a predetermined amount of time;

a calculator;

a plurality of numeric accumulators electrically communicable with said calculator for storing numeric values input into said calculator;

a plurality of numeric displays electrically coupled to said numeric accumulators for indicating a numeric value stored within each of said numeric accumulators;

a plurality of player selection switches in electrical communication with both said calculator and said accumulators for selectively placing an individual one of said accumulators in electrical communication with said calculator;

a plurality of lamps in electrical communication with said plurality of player selection switches, each of said lamps being responsive to an actuation of an individual one of said player selection switches so as to illuminate upon a first actuation thereof;

a plurality of game selection switches in electrical communication with said calculator for inputing a preset number into said accumulators;

a clear switch in electrical communication with said calculator for resetting at least one of said accumulators to a value of zero;

a plurality of button switches;

a cricket button switch in electrical communication with said button switches for selectively coupling said button switches to said accumulators;

a plurality of light emitting diodes, with each of said light emitting diodes having at least three operating states, each of said light emitting diodes being in electrical communication with both said accumulators and an individual associated one of said button switches such that said diode is energized to a first state upon a first actuation of said associated button switch, said diode is energized to a second state upon a second actuation of said associated button switch, and said diode is energized to a third state upon a third actuation of said associated button switch, wherein said first state comprises displaying a forward slash (/), said second state comprises displaying a reverse slash ( ), and said third state comprises displaying a combination of both said first and second states (X).

* * * * *